US005820023A

United States Patent [19]

Kristensson

[11] Patent Number: 5,820,023

[45] Date of Patent: Oct. 13, 1998

[54] DRINKING STRAW FOR PACKAGING CONTAINERS

[75] Inventor: Ingvar Kristensson, Veberöd, Sweden

[73] Assignee: Tetra Laval Holdings & Finance S.A., Pully, Switzerland

[21] Appl. No.: 596,171

[22] PCT Filed: Aug. 2, 1994

[86] PCT No.: PCT/EP94/02561

§ 371 Date: Apr. 3, 1996

§ 102(e) Date: Apr. 3, 1996

[87] PCT Pub. No.: WO95/05107

PCT Pub. Date: Feb. 23, 1995

[30] Foreign Application Priority Data

Aug. 16, 1993 [SE] Sweden ..... 9302646

[51] Int. Cl.[6] ..... A47G 21/18

[52] U.S. Cl. ..... 239/33

[58] Field of Search ..... 239/33; 285/399

[56] References Cited

U.S. PATENT DOCUMENTS

| | | | |
|---|---|---|---|
| 145,641 | 12/1873 | Fritsch | 285/399 X |
| 695,066 | 3/1902 | MacClain | 285/399 X |
| 942,306 | 12/1909 | Clarke | 239/33 |
| 3,106,312 | 10/1963 | Hitchcock | 220/709 |
| 3,189,171 | 6/1965 | Miller . | |
| 4,850,533 | 7/1989 | Hoshi et al. . | |
| 5,265,757 | 11/1993 | Wu | 220/709 X |

FOREIGN PATENT DOCUMENTS

| | | | |
|---|---|---|---|
| 172395 | 7/1984 | European Pat. Off. | 239/33 |
| 0 327 244 | 8/1989 | European Pat. Off. . | |
| 2532678 | 2/1976 | Germany | 239/229 |

*Primary Examiner*—Kevin Weldon
*Attorney, Agent, or Firm*—Burns, Doane, Swecker & Mathis, L.L.P.

[57] ABSTRACT

A drinking straw for packaging containers of the type which contains a consumer-ready portion of, for example, juice or other beverage consists of two tubular sections with interconnecting end portions. By using two tubular sections of the same diameter which are provided with specifically interconnecting end portions, the design and construction of the drinking straw will be rendered considerably cheaper and simpler. The interconnecting end portions display an area of reduced diameter and an outwardly flared portion, respectively, these being readily brought into frictional engagement with one another by the consumer.

8 Claims, 1 Drawing Sheet

Fig 1
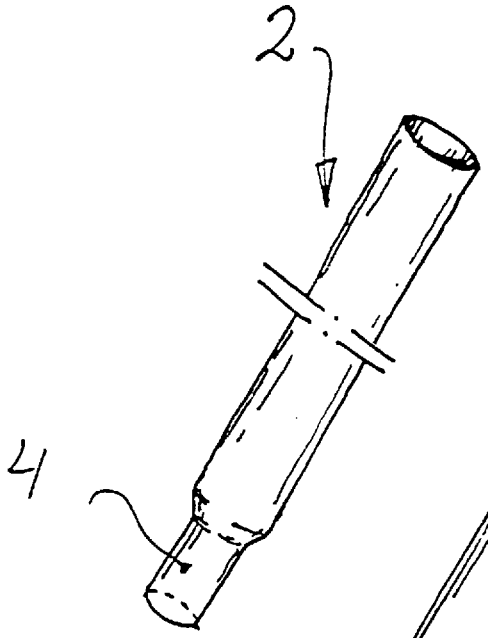
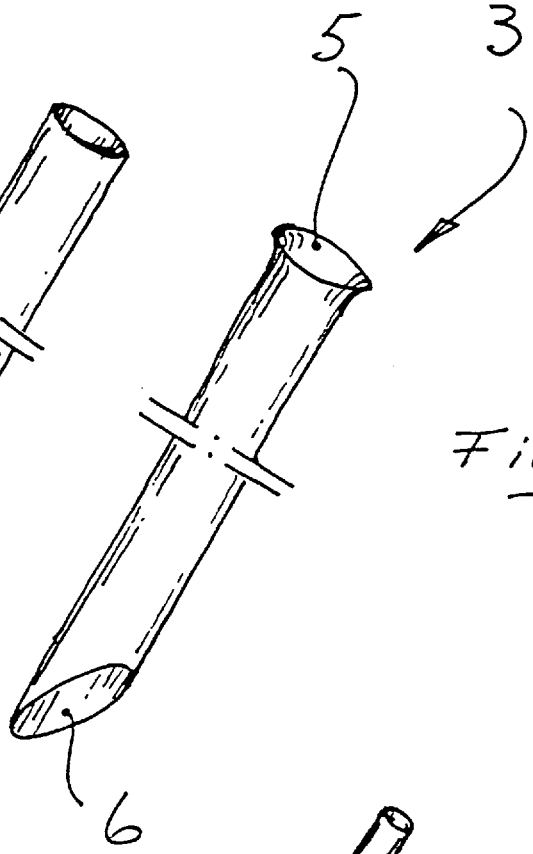
Fig 2
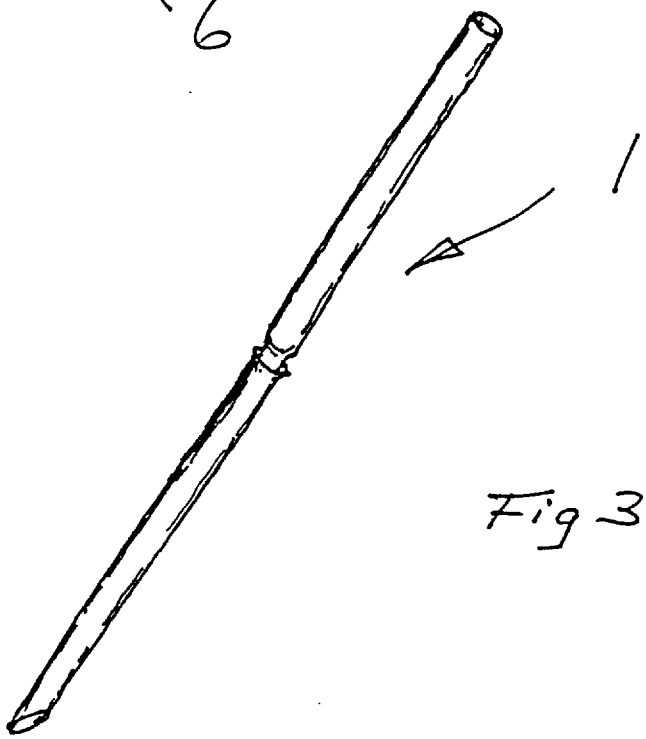
Fig 3

DRINKING STRAW FOR PACKAGING CONTAINERS

FIELD OF THE INVENTION

The present invention relates to a drinking straw and more particularly to a drinking straw for packaging containers, the drinking straw comprising two tubular sections with interconnecting end portions.

BACKGROUND OF THE INVENTION

Packaging containers in portion size for, for example, juice or other beverages intended to be consumed directly from the packaging container are becoming steadily more common. Packaging containers of this type are normally manufactured by fold formation and heat sealing of a paper/plastic laminate into a substantially parallelepipedic configuration. The packaging material is provided at the upper side of the packaging container with a weakened region which serves as an opening arrangement. In order to facilitate consumption of the contents of the package, the package is often provided with a drinking straw which is placed in a protective plastic envelope which, in turn, is connected to the outside of the packaging container with the aid of so-called hot-melt application. Using one end of the drinking straw (which is normally spiculated at an oblique angle), the weakened region of the packaging container wall may readily be punctured and penetrated so that the drinking straw may be pushed down into the packaging container and then used when the contents of the package are consumed.

Since it is not desirable that the drinking straw applied to the packaging container projects out, in the mounted state, beyond the outer contours of the parallelepipedic container, the technically feasible length of the drinking straw is automatically limited so that, when in use, only a short portion of the straw projects out from the packaging container. In order to obviate this drawback, a plurality of drinking straw designs and constructions have been proposed in the art. These include drinking straws provided with a bellows construction, and secured in the folded state on the packaging container, and telescopic drinking straws in which the sections thereof may be retracted into one another so that the length of the drinking straw in the inactive position may be reduced, and finally twin section drinking straws which are assembled together by the consumer before being pushed down into the packaging container. Both the bellows-fitted and the telescopic drinking straw types suffer from a certain instability which may be perceived as a disadvantage. This instability is wholly absent in the twin section drinking straw which may be assembled together by the consumer. For addition, in a given total length, this twin section drinking straw will be shorter than the other two types in the inactive (i.e. in the non-assembled) state.

Prior art drinking straws of the twin section type have consisted of two tubular sections of different diameters, i.e. the one tubular section has an inner diameter which substantially corresponds to the outer diameter of the other tubular section. On assembly of the drinking straw, its parts may be simply connected to one another, but the risk then arises that the parts are telescoped into one another, which, of course is undesirable. The principal drawback inherent in this prior art type of twin section drinking straw is, however, that the use of two tube types of different diameters considerably increases the costs involved for the drinking straw. This is associated not only with the fact that two different tube diameters must be manufactured, but also that the handling of two different diameters requires adaptation of the machinery and methods employed.

OBJECTS OF THE INVENTION

One object of the present invention is to devise a drinking straw for packaging containers, the drinking straw comprising two tubular sections which do not display the above-outlined drawbacks.

A further object of the present invention is to devise a drinking straw for packaging containers consisting of two tubular sections of the same diameter.

Yet a further object of the present invention is to devise a drinking straw of the above-mentioned type which is economical to produce, simple to handle and is of reliable and dependable design and construction.

SUMMARY OF THE INVENTION

These and other objects have been attained according to the present invention in that a drinking straw for packaging containers includes two tubular sections with interconnecting end portions, with the tubular sections being of the same diameter. The end portion of the one tubular section displays an area of reduced diameter while the end portion of the other tubular section has an outwardly flared region.

BRIEF DESCRIPTION OF THE ACCOMPANYING DRAWING FIGURES

One preferred embodiment of the drinking straw according to the present invention will now be described in greater detail hereinbelow, with particular reference to the accompanying drawing figures which show only those details essential to an understanding of the present invention. In the accompanying drawing figures:

FIG. 1 is an enlarged perspective view of a first end portion of a drinking straw according to the present invention;

FIG. 2 is an enlarged perspective view of a second end portion of a drinking straw according to the present invention; and FIG. 3 is a perspective view of a drinking straw according to the present invention in the assembled state.

DETAILED DESCRIPTION OF PREFERRED EMBODIMENT

A drinking straw 1 according to the invention comprises a first tubular section 2 and a second tubular section 3. Both the first and the second tubular sections substantially consist of a cylindrical tube whose diameter is between 4 and 6 mm. At its lower end (FIG. 1), the first tubular section 2 is provided with an end portion 4 of reduced diameter. The region of reduced diameter is of an outer diameter which substantially corresponds to the inner diameter displayed by both the tubular section 2 and the remainder of the tubular section 3. The length of the region of reduced diameter may be of the order of magnitude of between 5 and 8 mm.

For the major part of its length, the second tubular section 3 has the same outer diameter and inner diameter, respectively, as the first tubular section 2, while the upper end portion 5 (FIG. 2) of the second tubular section displays an outwardly flared or conical portion whose major inner diameter slightly exceeds the outer diameter of the end portion 4 of the first tubular section 2 of reduced diameter. The opposite end of the second tubular section 3 is designed with an obliquely cut or spiculated tip 6 in order to facilitate penetration through the wall of the packaging container.

FIG. 3 shows how both of the tubular sections 2 and 3 have been assembled together in that the end portion 4 of the tubular section 2 of reduced diameter has, with the aid of the outwardly flared end portion 5 of the second tubular section 3, been guided for a part of its length into and secured in the second tubular section by frictional engagement. In this assembled state, the drinking straw 1 has a total length of approx. 15 cm, while, in the unassembled state, both of the sections are approx. 8 cm in length. Since only a very short distance of both of the tubular sections is needed for the assembly operation, the total length of the drinking straw in the assembled state is substantially twice as great as the lengths of the individual tubular sections. Hence, although a drinking straw according to the invention does not, in its separated state, project beyond the outer contours of the packaging container, it will, in the assembled state, be of such length that it extends a good distance up above the upper surface of the packaging container, thus permitting the consumer conveniently to consume the last contents in the packaging container as well.

As a result of the design and construction according to the present invention, comprising two tubular sections of the same diameter, as well as specifically constructed interconnecting end portions, both manufacturing and handling costs for the drinking straw are considerably reduced as compared with prior art drinking straw designs and constructions. When put into practice, the design and construction according to the present invention have also proved capable of more than satisfying the requirements as established in the art.

The present invention should not be considered as restricted to that described above and shown in the drawing figures, many modifications being conceivable without departing from the spirit and scope of the appended claims.

What is claimed is:

1. A drinking straw for packaging containers, comprising first and second tubular sections each provided with an interconnecting end portion, the first tubular section having an internal diameter along a portion of the length of the first tubular section that is the same as the internal diameter of the second tubular section along a portion of the length of the second tubular section, the end portion of the first tubular section having a region of reduced outer diameter, while the end portion of the second tubular section has an outwardly flared portion for receiving the region of reduced outer diameter of the first tubular section to connect together the first and second tubular sections, the second tubular section having an obliquely cut tip located at the end opposite the outwardly flared portion.

2. The drinking straw as claimed in claim 1, wherein the end portion of reduced outer diameter has an outer diameter which substantially corresponds to the inner diameter of a portion of the second tubular section.

3. The drinking straw as claimed in claim 2, wherein the first and second tubular sections are of substantially the same length.

4. The drinking straw as claimed in claim 1, wherein the first and second tubular sections are of substantially the same length.

5. A drinking straw according to claim 1, wherein said first tubular section has an outer diameter that is substantially the same as the outer diameter of the second tubular section.

6. A drinking straw for attachment to a packaging container comprising a first tubular straw section having a first end portion and an oppositely positioned second end and a second tubular straw section having a first end portion and an oppositely disposed second end, said first end portion of said first tubular straw section being reduced in outer diameter relative to a remaining portion of the first tubular straw section, said first end portion of said second tubular straw section having an inner diameter that is enlarged relative to the inner diameter of a remaining portion of the second tubular straw section, the inner diameter of the remaining portion of the first tubular straw section being the same as the inner diameter of the remaining portion of the second tubular straw section, said first end portion of said second tubular straw section being adapted to receive the first end portion of the first tubular straw section to connect together the first and second tubular straw sections to thereby form a drinking straw, the second end of the second tubular straw section being obliquely cut.

7. A drinking straw according to claim 6, wherein said first tubular straw section has an outer diameter extending over the remaining portion of the first tubular straw section that is substantially the same as the outer diameter of the remaining portion of the second tubular straw section.

8. A drinking straw for attachment to a packaging container comprising a first tubular straw section having a first end portion and an oppositely positioned second end and a second tubular straw section having a first end portion and an oppositely disposed second end, said first end portion of said first tubular straw section being reduced in outer diameter relative to a remaining portion of the first tubular straw section, said first end portion of said second tubular straw section having an inner diameter that is enlarged relative to the inner diameter of a remaining portion of the second tubular straw section, the inner diameter of the remaining portion of the first tubular straw section being the same as the inner diameter of the remaining portion of the second tubular straw section, said first end portion of said second tubular straw section being adapted to receive the first end portion of the first tubular straw section to connect together the first and second tubular straw sections to thereby form a drinking straw, one of the second end of the second tubular straw section and the second end of the first tubular straw section being obliquely cut.

* * * * *